US009700749B2

(12) United States Patent
Carpinelli et al.

(10) Patent No.: US 9,700,749 B2
(45) Date of Patent: Jul. 11, 2017

(54) GRIP EXERCISER WITH INTERCHANGEABLE RESISTANCE ELEMENTS

(71) Applicant: Implus Footcare, LLC, Durham, NC (US)

(72) Inventors: John Angelo Carpinelli, Napa, CA (US); George Jeffery Mowry, Westcliffe, CO (US)

(73) Assignee: Implus Footcare, LLC, Durham, NC (US)

( * ) Notice: Subject to any disclaimer, the term of this patent is extended or adjusted under 35 U.S.C. 154(b) by 41 days.

(21) Appl. No.: 14/738,422

(22) Filed: Jun. 12, 2015

(65) Prior Publication Data

US 2016/0067539 A1 Mar. 10, 2016

Related U.S. Application Data

(60) Provisional application No. 62/045,896, filed on Sep. 4, 2014.

(51) Int. Cl.

| | |
|---|---|
| ***A63B 21/00*** | (2006.01) |
| ***A63B 21/02*** | (2006.01) |
| ***A63B 23/16*** | (2006.01) |

(52) U.S. Cl.

CPC .... *A63B 21/0004* (2013.01); *A63B 21/00072* (2013.01); *A63B 21/025* (2013.01); *A63B 21/4035* (2015.10); *A63B 23/16* (2013.01); *A63B 21/00061* (2013.01)

(58) Field of Classification Search

CPC ..... A63B 21/000061; A63B 21/023–21/025; A63B 21/4035; A63B 21/4049; A63B 23/16

See application file for complete search history.

(56) References Cited

U.S. PATENT DOCUMENTS

| | | | | |
|---|---|---|---|---|
| 1,026,215 | A | 5/1912 | Korth | |
| 5,060,934 | A * | 10/1991 | Winston | A63B 21/0004 482/126 |
| 5,308,299 | A | 5/1994 | Winston | |
| 9,415,262 | B2 * | 8/2016 | An | A63B 23/16 |
| 2010/0267523 | A1 * | 10/2010 | Wilkinson | A63B 21/00069 482/45 |

* cited by examiner

*Primary Examiner* — Sundhara Ganesan
*Assistant Examiner* — Jennifer M Deichl
(74) *Attorney, Agent, or Firm* — Edward S. Wright

(57) ABSTRACT

Exerciser for strengthening the grip of the hand having a pair of handles which are removably mounted on the arms of a helical torsion spring in a manner permitting springs having different strengths or resistances to be used interchangeably with the handles. The handles can be constrained against rotation on the spring arms, allowed to rotate freely, or allowed to rotate to a limited degree, depending upon the needs of the user.

18 Claims, 7 Drawing Sheets

Fig. 15
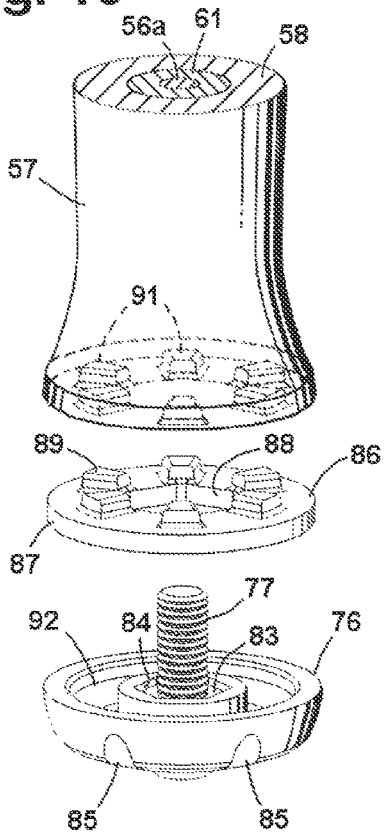
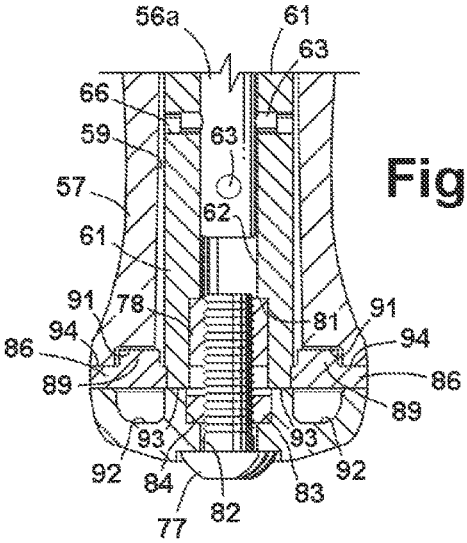
Fig. 16
Fig.17
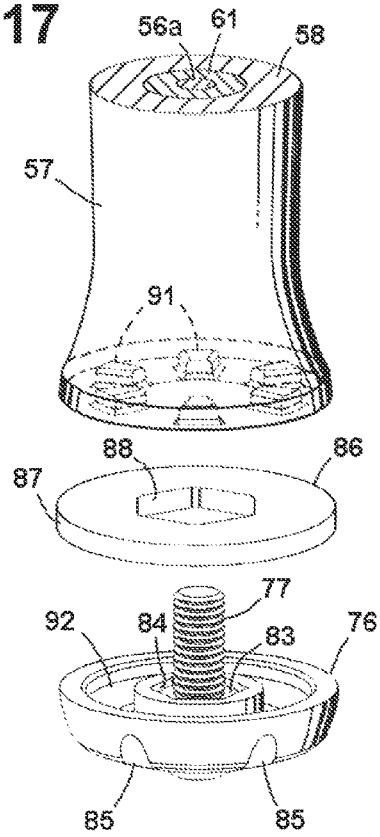
Fig. 18
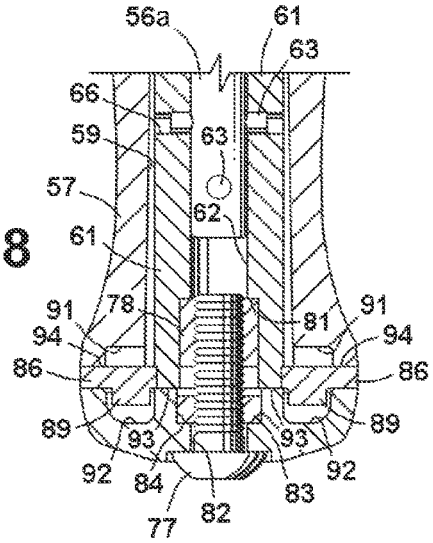

Fig. 19
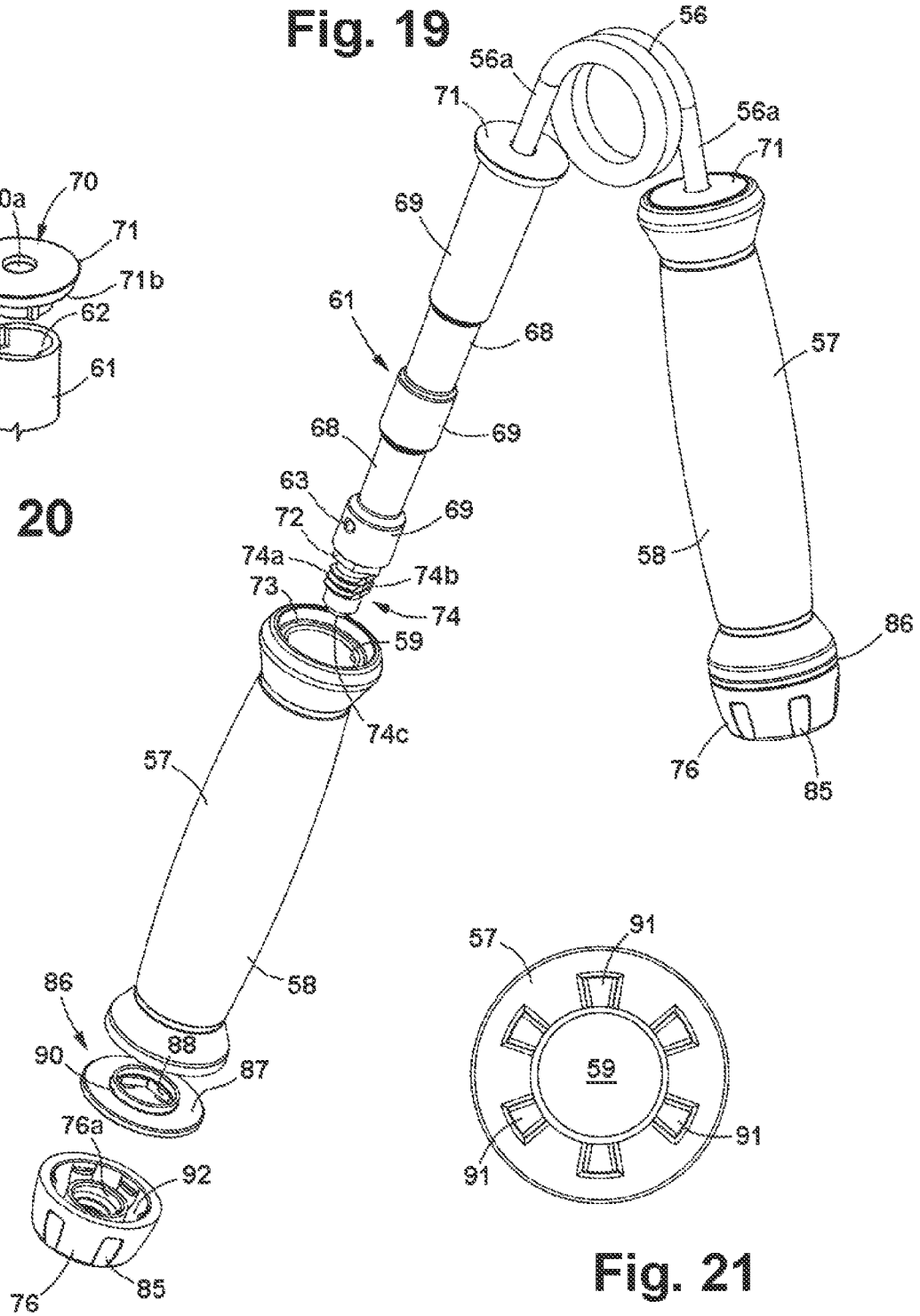
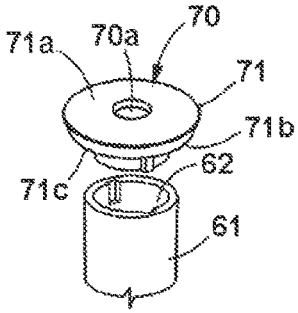
Fig. 20
Fig. 21

Fig. 22
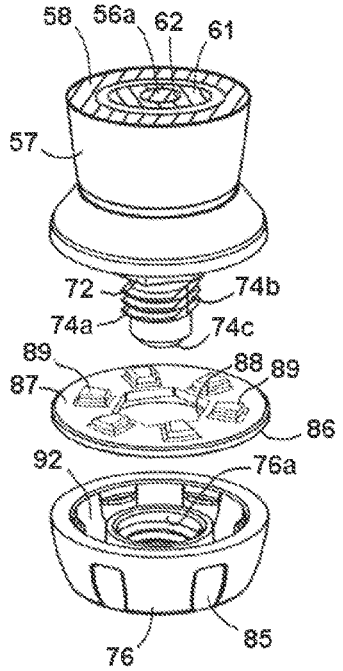
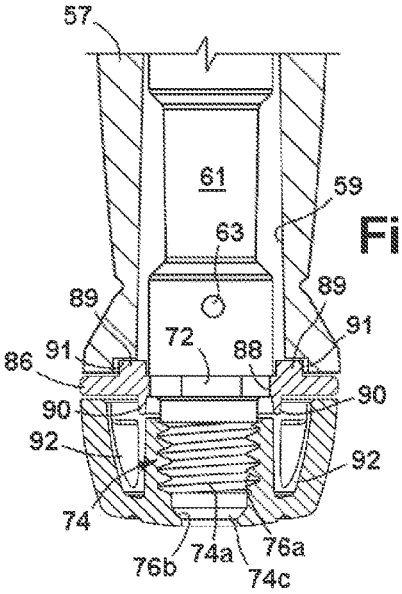
Fig. 23
Fig. 24
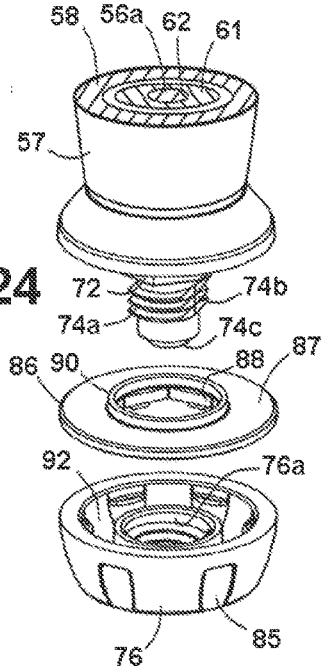
Fig. 25
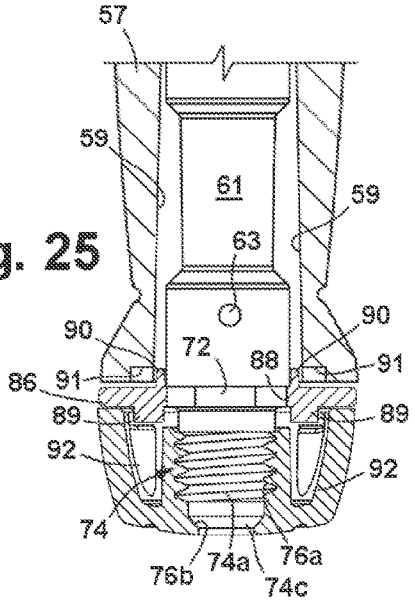

GRIP EXERCISER WITH INTERCHANGEABLE RESISTANCE ELEMENTS

RELATED APPLICATION

Provisional Application No. 62/045,896, filed Sep. 4, 2014, the priority of which is claimed.

BACKGROUND OF THE INVENTION

Field of Invention

This invention pertains generally to exercise and fitness equipment and, more particularly, to an exerciser with interchangeable resistance elements for strengthening the grip of the hand.

Related Art

Grip exercisers with handles or grips on the diverging arms of a helically coiled torsion spring are widely used in exercising and strengthening the muscles of the hand. Such devices are available in different sizes and resistances, and two examples are found in U.S. Pat. Nos. 5,060,934 and 5,308,299. Another patent (U.S. Pat. No. 1,026,215) shows a combined grip exerciser and dumbbell in which a dumbbell is mounted on one arm of the spring, and a grip is mounted on the other.

OBJECTS AND SUMMARY OF THE INVENTION

It is, in general, an object of the invention to provide a new and improved grip exerciser for strengthening the muscles of the hand.

Another object is to provide a grip exerciser of the above character which overcomes the limitations and disadvantages of grip exercisers heretofore provided.

These and other objects are achieved in accordance with the invention by providing an exerciser for strengthening the grip of the hand which comprises a plurality of helical torsion springs of different sizes and resistances each having a coiled section and a pair of arms extending from opposite ends of the coiled section, a pair of handles which are rotatably mounted on the arms of one of the springs and adapted to be interchangeably mounted on the arms of the other springs, and selectively engagable locks for permitting, limiting, or preventing rotation of the handles about the arms of the springs, depending upon the needs of the user.

BRIEF DESCRIPTION OF THE DRAWINGS

FIG. 15 is an enlarged, fragmentary, exploded isometric view of the embodiment of FIG. 14 with the grips constrained against rotation.

FIG. 16 is an enlarged, fragmentary, vertical sectional view of the embodiment of FIG. 14 with the grips constrained against rotation.

FIG. 17 is an enlarged, fragmentary, exploded isometric view of the embodiment of FIG. 14 with the grips free to rotate.

FIG. 18 is an enlarged, fragmentary, vertical sectional view of the embodiment of FIG. 14 with the grips free to rotate.

FIG. 19 is an exploded isometric view of another embodiment of a grip exerciser according to the invention.

FIG. 20 is a fragmentary, exploded isometric view of the embodiment of FIG. 19.

FIG. 21 is a bottom plan view of one of the grips in the embodiment of FIG. 19.

FIG. 22 is an enlarged, fragmentary, exploded isometric view of the embodiment of FIG. 19 with the grips constrained against rotation.

FIG. 23 is an enlarged, fragmentary, vertical sectional view of the embodiment of FIG. 19 with the grips constrained against rotation.

FIG. 24 is an enlarged, fragmentary, exploded isometric view of the embodiment of FIG. 19 with the grips free to rotate.

FIG. 25 is an enlarged, fragmentary, vertical sectional view of the embodiment of FIG. 19 with the grips free to rotate.

DETAILED DESCRIPTION

Figure 1:
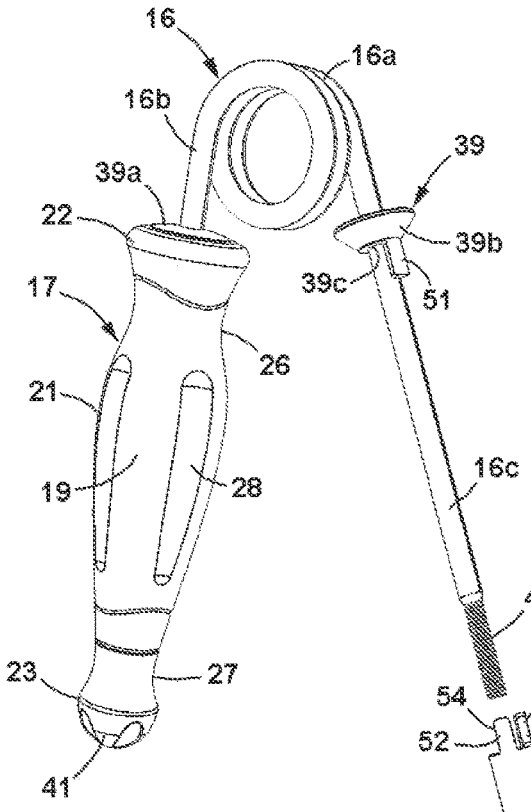
FIG. 1 is a partly exploded isometric view of one embodiment of a grip exerciser according to the invention, with a grip lock positioned to prevent rotation of hand grips about the arms of a spring.
Figure 2:
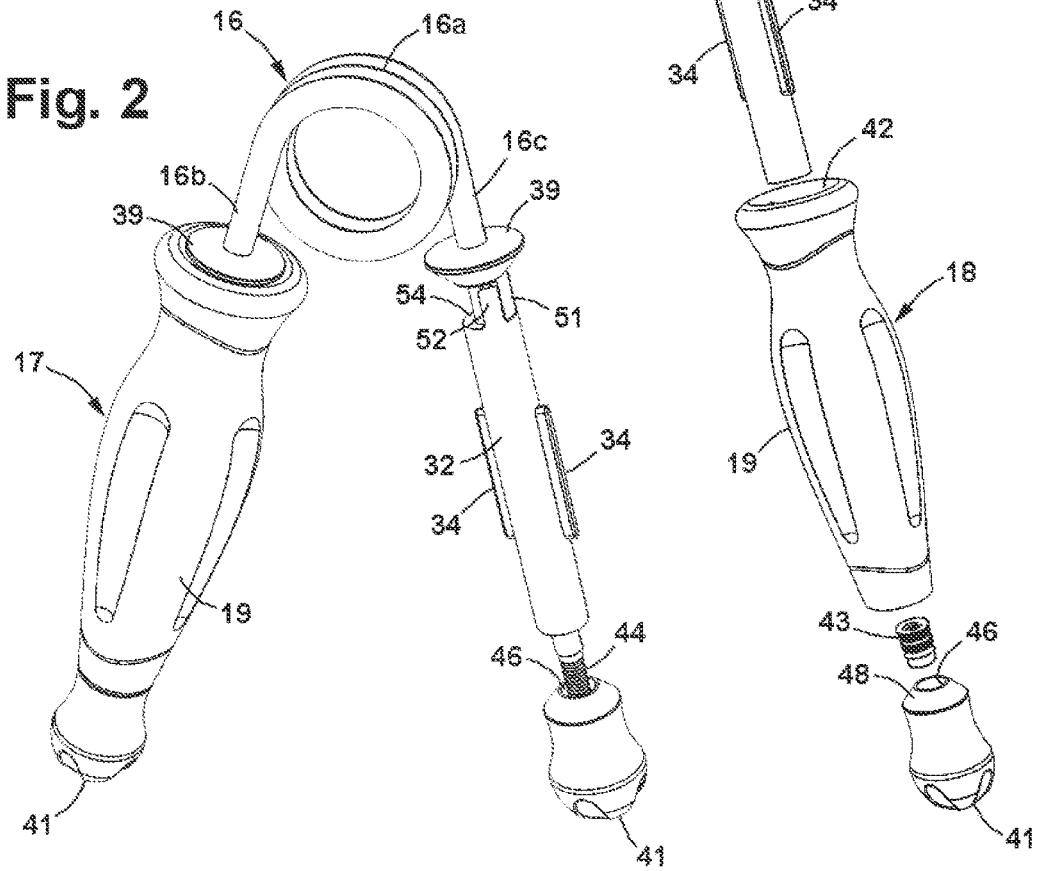
FIG. 2 is an isometric view, partly broken away, of the embodiment of FIG. 1.
Figure 3:
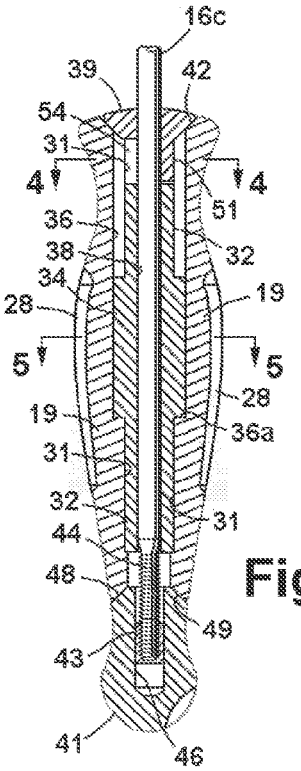
FIG. 3 is a fragmentary vertical sectional view of the embodiment of FIG. 1.
Figure 4:
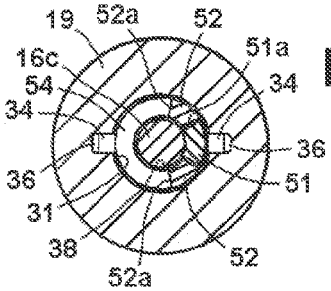
FIG. 4 is an enlarged horizontal sectional view taken along line 4-4 in FIG. 3.
Figure 5:
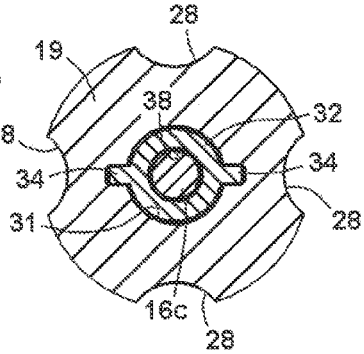
FIG. 5 is an enlarged horizontal sectional view taken along line 5-5 in FIG. 3.

As illustrated in FIGS. 1-13, the grip exerciser has a resistance element 16 in the form of a helical torsion spring with a coiled central section 16*a* and a pair of diverging arms 16*b*, 16*c* extending from opposite ends of the coil in planes generally perpendicular to the axis of the coil. In this embodiment, the coil has approximately 2½ convolutions or turns, and the arms diverge at an angle on the order of 30 degrees. However, the coil can have fewer or more turns, depending on the resistance level desired.

Hand grips or handles 17, 18 are mounted on the spring arms and adapted to be grasped by the hand and squeezed together against the force of the spring. Each of the grips has an elongated body 19 which is generally circular in cross section and contoured lengthwise to facilitate gripping. In the embodiment illustrated, the grips have a convexly curved central section 21, enlarged end sections 22, 23, and concavely curved sections 26, 27 between the other sections. The upper portion of the central section is of greater diameter and curvature than the lower portion, giving the grips a tapered shape. The grips are fabricated of a rigid material such as plastic, metal, or wood, with longitudinally extending grooves or flutes 28 spaced in quadrature about the peripheries of the central sections. If desired, the grips can be covered with a softer, more flexible material or one that enhances one's grip on the device.

The handles or grips are removably mounted on the spring in a manner permitting different springs to be used interchangeably in the device. The body of each handle has an axially extending bore 31 with a tubular insert or sleeve 32 disposed therein. The sleeve has a pair of longitudinally elongated, radially extending projections or ribs 34 which are received in corresponding slots 36 in the body to prevent rotation of the sleeve within the bore. The sleeve extends substantially the entire length of the bore, with the lower ends of the ribs abutting against walls 36*a* at the lower ends of the slots.

Sleeve 32 has an axially extending bore 38 of slightly larger diameter than spring arms 16*b*, 16*c* so that the handles can be slid onto and off of the springs and rotate about the axes of the spring arms.

The handles or grips are retained on the spring arms by ferrules 39 which are affixed to the upper end portions of the spring arms and by knobs or nuts 41 which are threadedly attached to the lower ends of the arms. Each of the ferrules has a generally frustoconical body with a rounded upper surface 39*a*, a conically inclined lower surface 39*b*, an axially extending opening 39*c* in which the spring arm is received, and a diameter less than the upper end of the body of the handle. The ferrules are affixed to the springs by suitable means such as welding, cementing, or threads, and are received in seats 42 formed in the upper end of the handle bodies.

Each of the knobs or nuts 41 has a body fabricated of the same material as the bodies of the handles, with an internally threaded insert 43 engagable with external threads 44 on the lower end portions of the spring arms. These inserts are press fit or otherwise locked in place in axially extending bores 46 in the knobs. Alternatively, if desired, the knobs or nuts can be fabricated of metal or another material that can be threaded, in which case the threaded inserts would not be required.

In addition to retaining the handles on the springs, the knobs also serve as the lower end portions of the handles and have a contour that blends with or matches handle bodies 19. In the embodiment illustrated, the knobs have beveled upper edges 48 which are received in matching beveled seats 49 in the lower ends of the handle bodies.

The embodiment of FIG. 1 includes means for preventing rotation of the handles or grips relative to the spring. This means includes a downwardly extending lug 51 on ferrule 39 that is captured between a pair of upwardly extending lugs 52 on sleeve 32. Lug 51 extends from the lower side of the ferrule body near opening 39*c* and adjacent to the spring arm, with a cross section in the shape of an annular sector and radially extending side faces 51*a*. Lugs 52 are formed as extensions of the side wall of sleeve 32 and likewise have cross sections in the shape of annular sectors and radially extending side faces 52*a*. Lugs 52 are spaced circumferentially apart, with gaps 53, 54 between facing edges of the lugs on opposite sides of the sleeves. In the embodiment illustrated, gap 53 has an arc length corresponding to the arc length, or width, of lug 51, and gap 54 has an arc length of 360 degrees minus the combined arc lengths, or widths, of lugs 52.

With sleeves 32 pressed into handle bodies 19 and threaded inserts 42 in knobs 41, the exerciser is assembled by sliding the handle bodies onto spring arms 16*b*, 16*c* until ferrules 39 are seated in the upper portions of the handle bodies and lugs 51 are captured between lugs 52. The knobs or nuts are then threaded onto the lower ends of the spring arms and tightened until the upper edges of the knobs are seated in the lower ends of the handle bodies and the handles are captured between the knobs and the ferrules, with lugs 51 in the gaps between lugs 52. The handles are removed by unscrewing the knobs and sliding the bodies of the handles off the spring arms.

Figure 7:
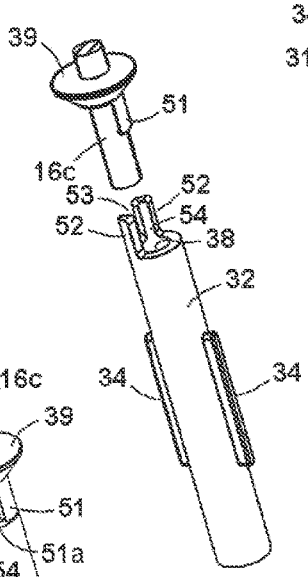
FIG. 7 is a fragmentary, exploded isometric view of the embodiment of FIG. 1, with the grip lock in the position shown in FIG. 6.
Figure 6:
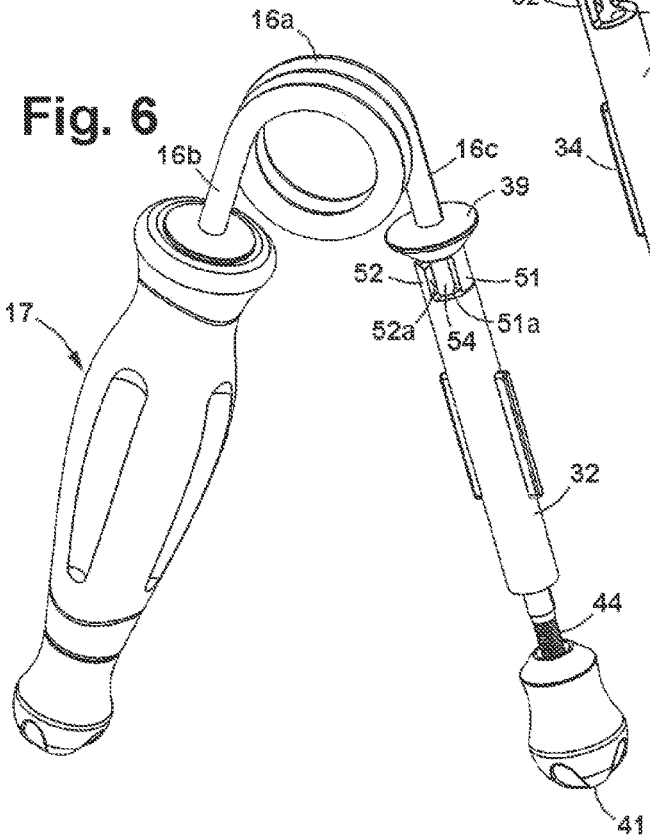
FIG. 6 is an isometric view, partly broken away, of the embodiment of FIG. 1 with the grip positioned to permit limited rotation of the hand grips about the arms of the spring.
Figure 8:
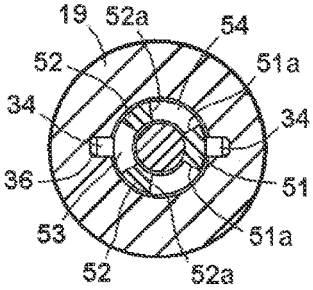
FIG. 8 is an enlarged horizontal sectional view of the embodiment of FIG. 1, with the grip lock in the position shown in FIG. 6.

When the handles are positioned on the spring arms with lugs 51 in the narrower gaps 53, as seen in FIGS. 1-4, the lugs prevent the handles from rotating. When the handles are positioned with lugs 51 in the wider gaps 54, as shown in FIGS. 6-8, the handles can rotate to a limited degree determined by the arc length of gap 54 and the width of lugs 51.

Figure 9:
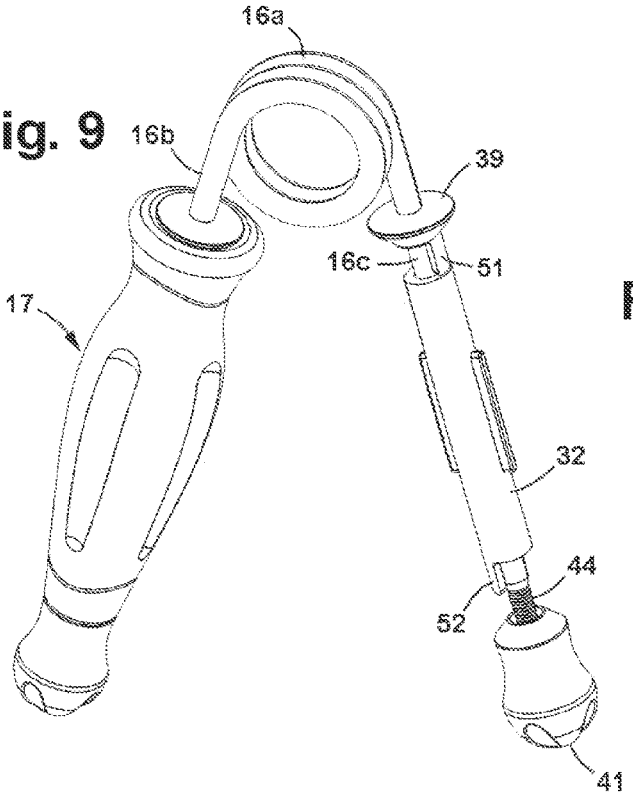
FIG. 9 is an isometric view, partly broken away, of the embodiment of FIG. 1 with the grip positioned to permit full rotation of the hand grips about the arms of the spring.
Figure 10:
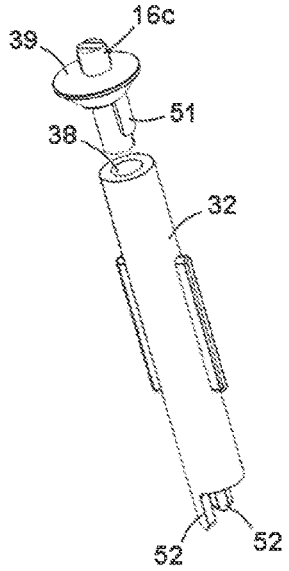
FIG. 10 is a fragmentary, exploded isometric view of the embodiment of FIG. 1, with the grip lock in the position shown in FIG. 9.
Figure 11:
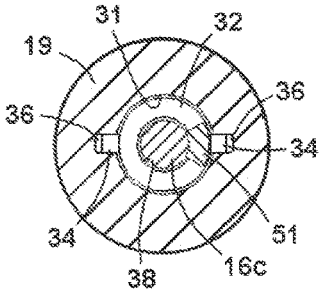
FIG. 11 is an enlarged horizontal sectional view, similar to FIG. 4, of the embodiment of FIG. 1, with the grip lock in the position shown in FIG. 9.

In FIGS. 9-11, sleeves 32 are shown as being turned end for end, with lugs 52 extending in a downward direction and no lugs extending from the upper ends of the sleeves to interact with lugs 51 and limit rotation of the handles.

Alternatively, if desired, different sleeves having different lug configurations can be utilized to provide different degrees of rotation, rather than using the same part in different positions. Similarly, the two handles can have different degrees or rotation, e.g. one handle that does not rotate at all and one with limited rotation, two handles with different degrees of limited rotation, one handle with limited or no rotation and one with unlimited rotation.

As noted above, the removable handles allow different springs to be used interchangeably in the device. Such springs might, for example, have resistances ranging from 50 to 300 pounds in 10 or 20 pound increments, and they can be packaged and sold in sets with the handles or sold individually. The resistance of the springs is dependent upon factors such as spring constants and diameter, and when springs having different diameters are used, they are all provided with threads 44 of the same size as the threaded inserts in knobs 41.

Figure 12:
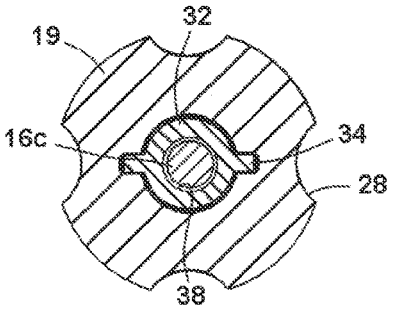
FIGS. 12 and 13 are enlarged horizontal sectional views, similar to FIG. 5, of the embodiment of FIG. 1, with springs of different diameters.
Figure 13:
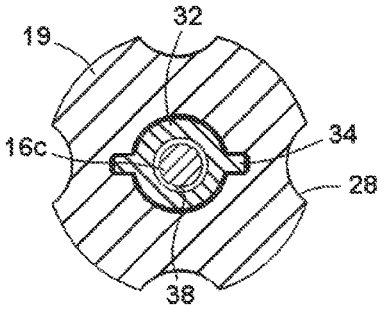
Figure 14:
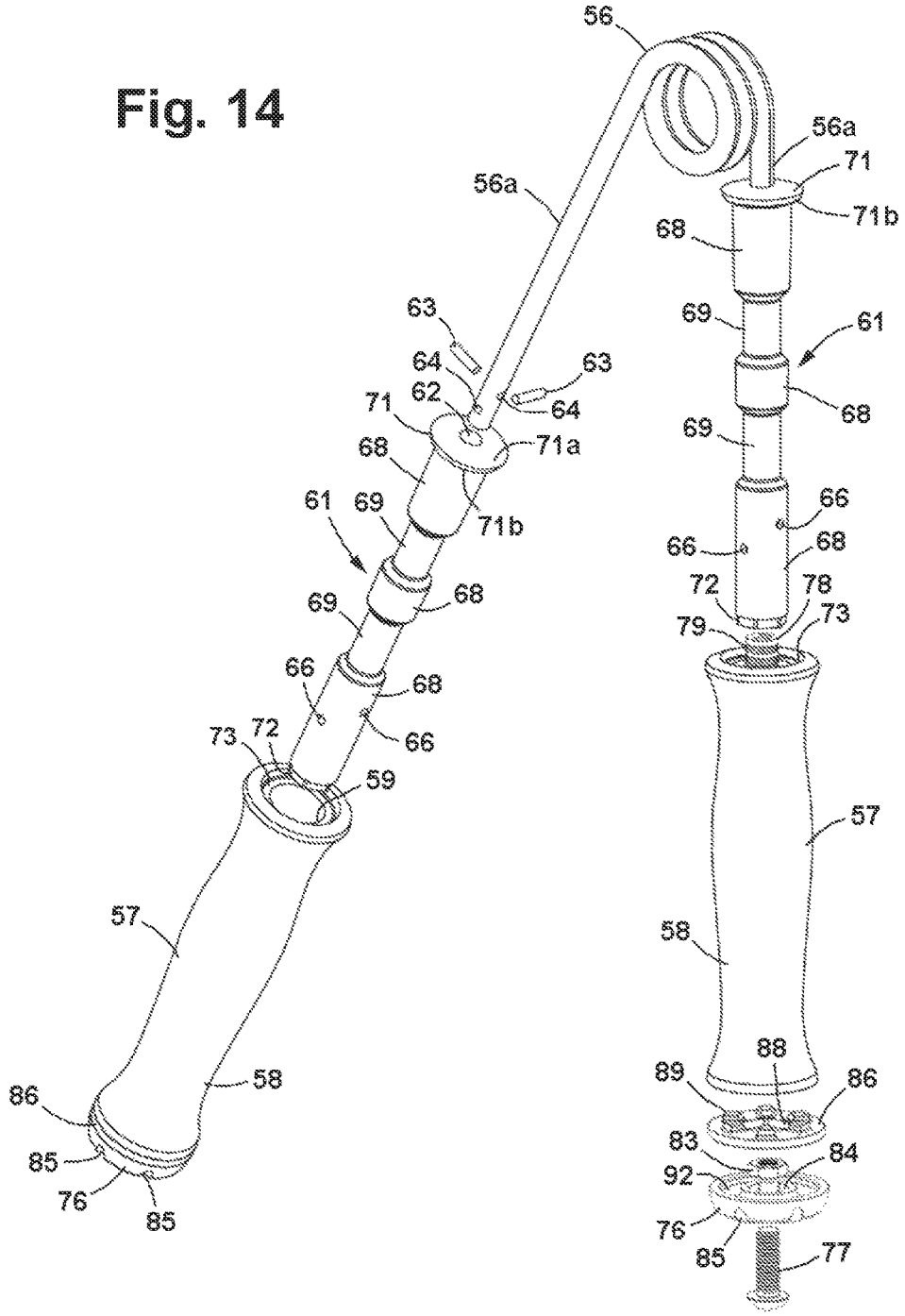
FIG. 14 is an exploded isometric view of another embodiment of a grip exerciser according to the invention.

With springs of smaller diameter, there will be larger gaps between the walls of spring arms 16*b*, 16*c* and the walls of bores 38, as illustrated in FIGS. 12-13. However, the spring arms will remain centered in the bores because of the centering action provided by the beveled seats 42, 49 for ferrule 39 and knob 41 toward the ends of the spring arms.

The embodiment of FIGS. 14-18 is similar to the embodiment of FIGS. 1-13 in that it includes a helical torsion spring 56 with handles or grips 57 on the arms 56*a* of the spring. In this embodiment, the coil has approximately 2½ convolutions or turns, and the grips are fabricated of a rigid material such as plastic, metal or wood and are mounted on the arms in a manner permitting them to be removed and utilized interchangeably with springs of different resistances.

The grips have elongated bodies 58 with axially extending bores 59. As in the previous embodiment, the grips are generally circular in cross section and contoured to facilitate gripping.

In this embodiment, the spring is part of an assembly which includes tubular sleeves or spindles 61 with axially extending bores 62 in which the arms of the spring are received. The spindles are affixed to the spring by dowel pins 63 that are pressed into aligned openings 64, 66 in the spring arms and spindles. If desired, other types of fasteners such as screws can be used instead of dowel pins for attaching the spindles to the springs.

The spindles have an outer contour that is stepped, with end and middle sections 68 of relatively large diameter and intermediate sections 69 of lesser diameter. The diameter of the larger sections is somewhat less than the diameter of bores 59 so the grips can rotate smoothly about the spring arms when mounted on them. The stepped contour requires less material and allows the spindles to be manufactured less expensively while still providing enough bearing surface for smooth rotation and a solid feel. Alternatively, if desired, the steps can be eliminated, and the spindles can have continuous, straight conical or cylindrical side walls.

The spindles also have radial flanges or ferrules 71 at one end and hexagonal bosses or hubs 72 at the other. The flanges have rounded upper surfaces 71*a* and conically inclined peripheral surfaces 71*b* which are received in conically inclined seats 73 at the upper ends of the grip bodies. The spindles are unitary structures fabricated of a rigid material such as plastic or metal, and are formed by a suitable process such as injection molding, turning, or casting.

The diameter of bores 62 corresponds to the diameter of the spring arms and differs for springs of different resistances, whereas the outer diameter of the spindles is the same regardless of spring size. Therefore, the springs and spindles can be packaged as units that can be used interchangeably with a single pair of grips.

The grips are retained on the spring by end caps or knobs 76 which are secured to the spring assembly by screws 77 that are received in threaded inserts 78 in the lower end portions of bores 62. The inserts are cylindrical and have knurled side walls 79 that engage the walls of the bores and prevent rotation of the inserts. In the embodiment illustrated, the inserts are fabricated of brass and are heated and pressed into the bores until they abut against annular shoulders 81. The heat from the brass softens the plastic walls which then fuse about the inserts, locking them in place.

End caps 76 and screws 77 are locked together for rotation, with the end caps serving as knobs for turning the screws. In this particular embodiment, the screws pass through openings 82 in the lower portions of the end caps and are secured to the end caps by nuts 83 that are received in hexagonal sockets 84 in the end caps. Dimples 85 are formed in the outer surfaces of the end caps to facilitate gripping of the end caps to turn the screws. Alternatively, if desired, the end caps can be secured to the spring assembly by other means such as pins, clips, and the like.

Rotation of the grips about the spring arms is controlled by lock rings or washers 86 disposed between the lower ends of the grips and the end caps. The lock rings have generally annular bodies 87 with hexagonal central openings 88 in which hexagonal hubs 72 are received to constrain the lock rings from rotation about the spring arms. Radially extending lugs or teeth 89 project from one side of the lock rings. When the lock rings are oriented with the lugs facing up, as illustrated in FIGS. 15-16, the lugs are received in downwardly opening notches or sockets 91 in the lower ends of the grip bodies, and the grips are thereby constrained against rotation relative to the lock rings and spring arms. When the lock rings are oriented with the lugs facing down, as illustrated in FIGS. 17-18, the lugs are received in upwardly opening circular channels or slots 92 in the end caps, and the grips are free to rotate about the spring arms.

The spring assemblies are preassembled by placing spindles 61 on spring arms 56*a* with openings 66 aligned with openings 64 and inserting dowel pins 63 into the aligned openings to lock the spindles and arms together. The end caps are preassembled by placing nuts 83 in sockets 84, inserting screws 77, and tightening the screws into locking engagement with the end caps.

The grips are installed on the spring by inserting the spring arms and spindles into bores 59 from the top until flanges 71 are seated in the upper ends of the grip bodies, with hexagonal hubs 72 extending beyond the lower ends. Lock rings 86 are then placed on the projecting hubs, with lugs 89 facing in the desired direction and screws 77 are threaded into inserts 78, using end caps 76 as knobs for turning the screws. The screws are tightened until the end caps abut against the lower surfaces 93 of the hexagonal hubs, with the grips being captured between flanges 71 and the upper surfaces 94 of the lock rings and free to rotate unless constrained by the lock rings.

As noted above, if rotation of the grips is not desired, the lock rings or washers are installed with lugs 89 facing up and extending into the notches 91 in the lower ends of the grip bodies, as illustrated in FIGS. 15-16. If rotation is desired, the lock rings or washers are installed with lugs 89 facing down and extending into channels 92 in end caps 76, as illustrated in 17-18.

Changing springs is simply a matter of twisting the end caps to disengage screws 77 from inserts 78, withdrawing the spring arms from the grips, placing the grips on the new spring, and reinstalling the end caps. Switching between rotating grips and locked grips is simply a matter of removing the end caps, turning the lock rings or washers over, and reinstalling the end caps.

The embodiment of FIGS. 19-25 is similar to the embodiment of FIGS. 14-18 except for the manner in which the grips are attached to the spindles, and like reference numerals designate corresponding elements in the two embodiments.

As in the previous embodiments, grips 57 are mounted on the arms 56*a* of a helical torsion spring 56. The grips have elongated bodies 58 with axially extending bores 59, and are generally circular in cross section and contoured to facilitate gripping. The grips are fabricated of a rigid material such as plastic, metal or wood and are mounted on the arms in a manner permitting them to be removed and utilized interchangeably with springs of different resistances.

Here again, the spring is part of an assembly that also includes tubular sleeves or spindles 61 with axially extending bores 62 in which the arms are received and secured by dowel pins 63 or other suitable fasteners such as screws. The spindles are once again shown as having an outer contour that is stepped, with end and middle sections 68 of relatively large diameter and intermediate sections 69 of lesser diameter.

However, they can also have straight, continuous cylindrical or conical side walls, if desired. The diameter of the larger sections is somewhat less than the diameter of bores 59 so the grips can rotate smoothly about the spring arms when mounted on them.

In this embodiment, the radial flanges 71 at the upper ends of the spindles are formed by caps or plugs 70 that are received in the upper end portions of bores 62. The flanges have rounded upper surfaces 71*a*, conically inclined peripheral surfaces 71*b*, and flat, annular lower surfaces 71*c* which are rotatably received in matching seats 73 in the upper ends of the grip bodies. Threaded stems 74 extend downwardly from hexagonal hubs 72 for use in attaching end caps 76 to the spindles. The spindles and caps are fabricated of a rigid material such as plastic or metal and by a suitable process such as molding, turning, or casting. In FIG. 19, the stem is shown as having an interrupted thread 74*a* with flats 74*b* on opposite sides of the stem, which facilitates removal of the spindle from the mold. The caps are permanently affixed to the spindles by suitable means such as sonic welding or cementing.

Spring arms 56*a* pass through axial bores 70*a* in the upper walls of spindle caps 70 and are seated in sections of reduced diameter at the lower ends of bores 62, which keeps the spring arms centered within the grips. The diameter of the bores corresponds to the diameter of the spring arms and differs for springs of different resistances. However, the outer diameter of the spindles is the same regardless of spring size, and the springs and spindles can, therefore, be packaged as units that can be used interchangeably with a single pair of grips.

The grips are retained on the spring arms by end caps 76 with female threads 76*a* that engage the male threads 74*a* on the threaded stems at the outer ends of the spring arms. The stems have chamfered tips 74*c* which abut against corresponding sockets 76*b* in the end caps as the caps are tightened onto the stems, with dimples 85 in the outer surfaces of the end caps facilitate gripping and turning of the end caps. Here again, the end caps can be secured to and retained on the spring arms by other suitable means such as pins, clips, and the like, if desired.

As in the embodiment of FIGS. 14-18, rotation of the grips about the spring arms is controlled by lock rings or washers 86 disposed between the lower ends of the grips and the end caps. The lock rings have generally annular bodies 87 with hexagonal central openings 88 in which hexagonal hubs 72 are received to constrain the lock rings from rotation about the spring arms. Radially extending lugs or teeth 89 project from one side of the lock rings, and axially extending annular flanges 90 project from the other. When the lock rings are oriented with the lugs facing up, as illustrated in FIGS. 22-23, the lugs are received in downwardly opening notches or sockets 91 in the lower ends of the grip bodies, and the grips are thereby constrained against rotation. When the lock rings are oriented with the lugs facing down, as illustrated in FIGS. 24-25, the lugs are received in upwardly opening circular channels or slots 92 in the end caps, and the grips are free to rotate about the spring arms. The outer diameter of annular flanges 90 is slightly less than the diameter of bores 59, and the flanges extend into the lower ends of the bores and keep the grips centered about the spring arms when the lock rings are in the unlocked position.

As in the embodiment of FIGS. 14-18, the spring assemblies are preassembled by placing spindles 61 on spring arms 56*a* and installing dowel pins 63 to lock the spindles and arms together.

The grips are installed on the spring by inserting the spring arms and spindles into bores 59 from the top until flanges 71 are seated in seats 73 in the upper ends of the grip bodies, with hexagonal hubs 72 and threaded stems 74 extending beyond the lower ends. Lock rings 86 are then placed on the projecting hubs, with lugs 89 facing in the desired direction and end caps 76 are installed on the threaded stems. The end caps are tightened until the chamfered tips 74*c* of the stems abut against the walls 76*b* of the sockets in the end caps, with the grips being captured between flanges 71 and the upper surfaces 94 of the lock rings and free to rotate unless constrained by the lock rings.

Here again, if rotation of the grips is not desired, the lock rings or washers are installed with lugs 89 facing up and extending into the notches 91 in the lower ends of the grip bodies, as illustrated in FIGS. 22-23. If rotation is desired, the lock rings or washers are installed with lugs 89 facing down and extending into channels 92 in end caps 76, as illustrated in FIGS. 24-25.

Changing springs is simply a matter of twisting the end caps to disengage them from threaded studs 74, withdrawing the spring arms from the grips, placing the grips on the new spring, and reinstalling the end caps. Switching between rotating grips and locked grips is simply a matter of removing the end caps, turning the lock rings over, and reinstalling the end caps.

Although hubs 72 and openings 88 are illustrated as being hexagonal in the embodiments of FIGS. 14-18 and 19-25, they could be triangular, square, elliptical, or any other noncircular configuration that will prevent rotation between the lock rings and spring assemblies.

The invention has a number of important features and advantages. It provides a grip exerciser having handles mounted on the arms of a spring in a manner permitting springs having different resistances to be used interchangeably in one device, thereby eliminating the need for a separate exerciser for each level of resistance desired. The manner in which the handles are mounted also provides a choice between no rotation, limited rotation, or full rotation of the handles on the spring.

It is apparent from the foregoing that a new and improved grip exerciser has been provided. While only certain presently preferred embodiments have been described in detail, as will be apparent to those familiar with the art, certain changes and modifications can be made without departing from the scope of the invention as defined by the following claims.

The invention claimed is:

1. An exerciser for strengthening the grip of the hand, comprising a plurality of helical torsion springs of different sizes and resistances each having a coiled section and a pair of arms extending from opposite ends of the coiled section, a pair of handles which are rotatably mounted on the arms of one of the springs with the arms of the spring being substantially coextensive in length with the handles and providing rotational support for the handles throughout the entire lengths of the handles and the handles being adapted to be interchangeably mounted on the arms of the other springs in the same manner, and selectively engagable locks for permitting, limiting, or preventing rotation of the handles about the arms of the springs.

2. The grip exerciser of claim 1 wherein handles are rotatively mounted on spindles which are mounted on and affixed to the spring arms and are also substantially coextensive in length with the handles.

3. The grip exerciser of claim 2 wherein the handles have longitudinally extending bores in which the spindles are received, the spindles have bores corresponding in size to the spring arms on which they are mounted, and the spindles on all of the springs have the same outer diameter so that the handles rotate smoothly on the springs of different sizes and resistances.

4. An exerciser for strengthening the grip of the hand, comprising a plurality of helical torsion springs of different sizes and resistances each having a coiled section and a pair of arms extending from opposite ends of the coiled section, a pair of handles which are rotatably mounted on the arms of one of the springs and adapted to be interchangeably mounted on the arms of the other springs, the handles having longitudinally extending bores with sleeves in the bores that are affixed to the handles and rotatably mounted on the spring arms, and lugs on the spring arms and sleeves which can be brought into abutting engagement with each other to limit or prevent rotation of the handles.

5. The grip exerciser of claim 4 wherein the handles can be installed on the spring arms in different predetermined positions in which the lugs on the sleeves are positioned to engage or clear the lugs on the spring arms upon rotation of the handles.

6. An exerciser for strengthening the grip of the hand, comprising a plurality of helical torsion springs of different sizes and resistances each having a coiled section and a pair of arms extending from opposite ends of the coiled section, a pair of handles which are rotatably mounted on the arms of one of the springs and adapted to be interchangeably mounted on the arms of the other springs, and annular lock rings which are removably connected to the spring arms, constrained against rotation relative to the spring arms, and have lugs on one side which engage the handles and prevent rotation of the handles about the spring arms when the lock rings are oriented with the lugs facing toward the handles, the handles being free to rotate when the lock rings are oriented with the lugs facing away from the handles.

7. An exerciser for strengthening the grip of the hand, comprising a plurality of helical torsion springs of different sizes and resistances each having a coiled section and a pair of arms extending from opposite ends of the coiled section, a pair of handles which are rotatably mounted on the arms of one of the springs and adapted to be interchangeably mounted on the arms of the other springs, with the spring arms extending through the handles and the handles are being retained on the spring arms by ferrules which are affixed to the spring arms and rotatively seated against the inner ends of the handles and by end caps that are attached to the outer ends of the spring arms and rotatively seated against the outer ends of the handles, and selectively engagable locks for permitting, limiting, or preventing rotation of the handles about the arms of the springs.

8. An exerciser for strengthening the grip of the hand, comprising a plurality of helical torsion springs of different sizes and resistances each having a coiled section and a pair of arms extending from opposite ends of the coiled section, a pair of handles having longitudinally extending bores with sleeves in the bores that are affixed to the handles and rotatably mounted on the arms of one of the springs and adapted to be interchangeably mounted on the arms of the other springs, and selectively engagable locks comprising lugs on the arms of the spring and the sleeves for controlling rotation of the handles about the arms of the springs, wherein the handles can be mounted on the arms of the spring with the lugs in different positions for preventing, limiting, or permitting rotation of the handles.

9. The grip exerciser of claim 8 wherein each of the sleeves has a pair of lugs spaced circumferentially apart with gaps of different arc length between facing edges of the lugs on opposite sides of the sleeve, and the handles can be installed with the lugs on the spring arms in either of the gaps.

10. The grip exerciser of claim 9 wherein the handles can also be installed with the lugs on the sleeves and the lugs on the spring arms at opposite ends of the handles, with the handles free to rotate about the spring arms.

11. An exerciser for strengthening the grip of the hand, comprising a plurality of helical torsion springs of different sizes and resistances each having a coiled section and a pair of arms extending from opposite ends of the coiled section, spindles of common outer diameter mounted on and affixed to the arms of the springs, a pair of handles rotatably mounted on the spindles on the arms of one of the springs and adapted to be interchangeably mounted in like manner on the arms of the other springs, and annular lock rings which are removably mounted on the spindles, constrained from rotation about the spring arms, and have lugs on one side which engage the handles and prevent rotation of the handles about the spring arms when the lock rings are mounted on the spindles with the lugs facing toward the handles, the handles being free to rotate when the lock rings are mounted on the spindles with the lugs facing away from the handles.

12. The grip exerciser of claim 11 wherein the lock rings are constrained from rotation by non-circular hubs on the spindles which are received in non-circular openings in the lock rings.

13. The grip exerciser of claim 12 wherein the hubs and openings are hexagonal in shape.

14. The grip exerciser of claim 11 wherein the handles are retained on the spring arms by end caps which are attached to the outer ends of the spindles, and the lock rings are disposed between the end caps and the outer ends of the handles.

15. The grip exerciser of claim 11 including downwardly opening sockets in the outer ends of the handles, with the lugs being received in the sockets in interlocking relationship when the lock rings are turned with the lugs facing toward the handles.

16. The grip exerciser of claim 11 wherein the end caps have upwardly opening circular channels in which the lugs can rotate freely when the lock rings are turned with the lugs facing away from the handles.

17. The grip exerciser of claim 11 wherein the handles are retained on the spring arms by end caps with screws that are threadedly connected to outer end portions of the spindles.

18. The grip exerciser of claim 11 wherein the spindles have threaded stems at their outer ends, and the handles are retained on the spring arms by end caps which are threaded onto the stems.

* * * * *